US006148930A

United States Patent [19]

Berger et al.

[11] Patent Number: 6,148,930

[45] Date of Patent: Nov. 21, 2000

[54] PERCUSSION DRILL AND/OR JACK HAMMER WITH HANDLE SPRING-BUFFERED AGAINST THE HAMMER HOUSING

[75] Inventors: Rudolf Berger, Grünwald; Thomas Maurer, München, both of Germany

[73] Assignee: Wacker-Werke GmbH & Co. KG, Germany

[21] Appl. No.: 09/331,941

[22] PCT Filed: Dec. 22, 1997

[86] PCT No.: PCT/EP97/07237

§ 371 Date: Jun. 25, 1999

§ 102(e) Date: Jun. 25, 1999

[87] PCT Pub. No.: WO98/29220

PCT Pub. Date: Jul. 9, 1998

[30] Foreign Application Priority Data

Jan. 2, 1997 [DE] Germany ..... 297 00 003 U

[51] Int. Cl.[7] ..... B25D 17/00; B25G 1/00

[52] U.S. Cl. ..... 173/162.2; 173/211; 267/137

[58] Field of Search ..... 173/162.2, 162.1, 173/210, 211; 267/137, 141, 141.4

[56] References Cited

U.S. PATENT DOCUMENTS

| | | | |
|---|---|---|---|
| 2,875,731 | 3/1959 | Settles et al. | 173/162.2 |
| 3,053,526 | 9/1962 | Kendall | 267/141.4 |
| 4,282,938 | 8/1981 | Minamidate | 173/162.2 |
| 4,401,167 | 8/1983 | Sekizawa et al. | 173/162.1 |
| 4,478,293 | 10/1984 | Weilenmann et al. | 173/162.2 |
| 4,800,965 | 1/1989 | Keller | 173/162.2 |
| 5,052,500 | 10/1991 | Ohtsu | 173/162.2 |
| 5,269,381 | 12/1993 | Oscarsson | 173/162.2 |
| 5,273,120 | 12/1993 | Chang | 173/162.2 |
| 5,413,318 | 5/1995 | Andreassen | 173/211 |
| 5,522,466 | 6/1996 | Harada et al. | 173/162.2 |
| 5,697,456 | 12/1997 | Radle et al. | 173/162.2 |

FOREIGN PATENT DOCUMENTS

| | | |
|---|---|---|
| 0 066 779 | 5/1982 | European Pat. Off. . |
| 0 206 981 | 4/1986 | European Pat. Off. . |
| 0 370 952 | 11/1989 | European Pat. Off. . |
| 39 13971 | 11/1989 | Germany . |
| 83 02 481 | 5/1990 | Germany . |
| 565783 | 11/1944 | United Kingdom . |
| 2 171 045 | 8/1986 | United Kingdom . |

*Primary Examiner*—Peter Vo
*Assistant Examiner*—Jim Calve
*Attorney, Agent, or Firm*—Boyle Frederickson Ziolkoski S.C.

[57] ABSTRACT

A percussion drill and/or jack hammer has a handle that is spring-buffered against the hammer housing which has at least one straight guiding track running parallel to the longitudinal axis of the hammer. The handle can be moved to a limited extent along the guiding track in relation to the hammer housing and is spring-buffered in such a way that its movement against the guiding track is limited on all sides.

19 Claims, 1 Drawing Sheet

PERCUSSION DRILL AND/OR JACK HAMMER WITH HANDLE SPRING-BUFFERED AGAINST THE HAMMER HOUSING

BACKGROUND OF THE INVENTION

1. Field of the Invention

The invention relates to a breaking and/or drilling hammer with a handle which is resiliently biased with respect to the hammer casing.

2. Description of the Related Art

The previously known resiliently biased systems for reducing the vibration transmitted to the hand and arm are configured such that an angular offset between the device and the handle is prevented, or the longitudinal springing in the direction of action of the tool and the lateral springing are designed to be approximately equal and rather hard, with the result that the damping of the vibration leaves something to be desired.

In addition, fixed springing having an invariant spring characteristic and a relatively short spring travel has proven to be disadvantageous, since it does not allow adaptation to different operating conditions, such as, in particular, the type of material to be worked.

GB-A-565,783 discloses a hammer with a handle which is resiliently biased on all sides with respect to a hammer casing in a manner such that it can move to a limited extent, and which can be displaced to a limited extent with respect to the hammer casing along two rectilinear guides. Each of the rectilinear guides has a guide rod and a guide sleeve, between which a rubber element is arranged for the purpose of springing, this rubber element being loaded in shear when the hammer is operated. Because of the shear forces, there is the risk that the connection between the handle and the hammer casing will become detached. Because of the slight guiding action of the rectilinear guides, the hammer is, moreover, difficult to handle.

Another vibration-insulating handle connection design is disclosed by DE-A-39 13 971, but this was developed for hand-held abrasive disk grinders and is not suitable for use in hammers in which primarily high forces act in the longitudinal direction of the hammer.

Further examples of vibration-damped handles will be found in U.S. Pat. No. 4,401,167 and EP-A-0 066 779.

OBJECTS AND SUMMARY OF THE INVENTION

The object of the invention is to configure a breaking and/or drilling hammer with a handle which is resiliently biased with respect to the hammer casing in such a way that, with a simple and cost-effective design, it provides the most effective possible protection of the hand and arm against the tool vibration and, in doing so, permits, on the one hand, damping which is effective in all directions and preferably in the axial direction of the hammer, yet at the same time the reliable guidance of the tool as well, the intention being to enable a certain angular offset between the device and handle, in spite of linear guidance.

In order to improve the ability of the device to be guided, the intention is, moreover, to enable a distinct difference between the lateral springing and the longitudinal springing of the tool to be implemented. In addition, there should be the possibility of adapting the device to different operating conditions by means of any desired selection of the spring characteristic, for which purpose a longer spring travel than hitherto is also intended to be permitted.

This object is achieved by at least one rectilinear guide which extends parallel to the longitudinal axis of the hammer, along which the handle can be displaced to a limited extent with respect to the hammer casing and with respect to which said handle is sprung on all sides so that it can move to a limited extent; according to a preferred embodiment, the handle has a U shape with essentially mutually parallel legs turned toward the hammer casing, there being in each leg a rectilinear guide enclosed by said leg.

On the one hand, this permits good guidance of the device, while the springing, which is effective on all sides and preferably in the axial direction, also permits an angular offset between device and handle.

A further advantageous refinement is that each rectilinear guide comprises a guide rod which extends essentially parallel to the longitudinal axis of the hammer casing and projects from the latter toward the handle, and a guide sleeve formed in the handle.

This provides the further advantage that good sealing against penetrating dirt, and hence a high insensitivity to dirt, and thus a contribution to a long service life of the device, are achieved.

One preferred refinement is that the guide sleeve in each case comprises a fixed bushing in the handle and a liner which is inserted into the bushing. The liner is retained axially in the bushing, is formed from a resilient material, and is provided with a bore that extends at least over the length of the guide rod and has a cross section matching the latter. According to a first variant, the liner is also retained in the axial direction on the guide rod.

By means of suitable dimensioning of the resilient liner, it is possible to achieve different springing in the guide direction and transversely thereto, for which purpose, according to a further advantageous feature, the guide rod can be axially sprung in the bore. According to a preferred embodiment, this effect is achieved by a compression spring that is supported on the free end of the guide rod and on the bottom of the bush.

Particularly simple adaptation of the damping action in the guide direction and transversely to this is achieved by liner parts which can be inserted into the bushing in a manner allowing them to be replaced, and which have different compressibility, it also being possible for the compression springs to be replaced by such a liner part.

There is particular advantage for the dimensioning of the axial movement, extending in the guide direction, between the device and handle in a further refinement by means of a radial projection on the guide rod. The projection engages in a radial recess which is present in the liner and has an axial length that corresponds to the maximum permissible displacement travel between the hammer casing and handle. The radial projection may be formed as an annular shoulder.

BRIEF DESCRIPTION OF THE DRAWINGS

The invention will be explained in more detail using the description which now follows of the exemplary embodiments of the invention which are illustrated in the drawing, in which.

DESCRIPTION OF THE PREFERRED EMBODIMENTS

Figure 1:
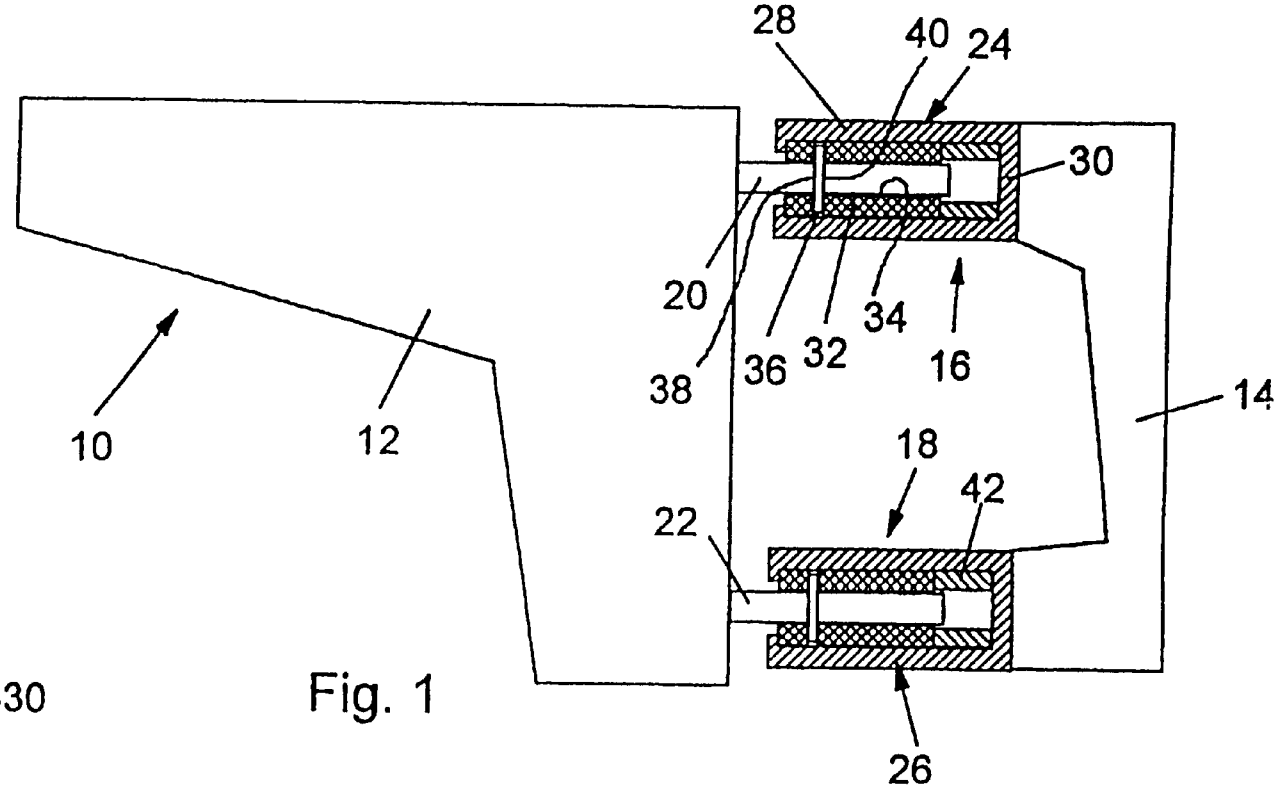
FIG. 1 shows a partly sectional, schematic side view of a breaking and/or drilling hammer.

Referring to FIG. 1, a breaking and/or drilling hammer, designated overall by 10, essentially comprises two parts, namely the device which carries the tool and its drive, illustrated only schematically by its casing 12, and a U-shaped handle 14. The handle 14 is used to handle and guide the device and has two legs 16 and 18 which extend essentially parallel to one another and also approximately parallel to the direction of vibration of the tool carried by the casing 12.

The casing 12 is provided with two guide rods 20 and 22, which project from the housing 12 toward the handle 14, approximately in the direction of vibration. Each guide rod penetrates into one of the legs 16 and 18, respectively, and engages in a guide sleeve 24 and 26, respectively.

Each guide sleeve 24 and 26 has a bushing 28, which is permanently fitted in the handle and which has a bottom 30 at its end facing away from the casing 12. Located in the bushing 28 is at least one liner 32 which is made of resilient material and which is provided with a central bore 34 whose cross section is matched to the cross section of the guide rods 20 and 22. The liner 32 is retained in the axial direction in the bushing 28. The length of the bore 34 is such that it is able to accommodate the entire length of the guide rod 20 or 22 which penetrates into the guide sleeve 24 or 26, respectively. Between the respective guide rod 20 and 22 and the liner 32, there is also a connection which is permanent in the axial direction and which, in the embodiment according to FIG. 1, is created by a cross-sectional widening 36 which forms an annular collar. The collar 36 engages in the cross section of the liner 32 and, in the two axial directions, is able to transmit axial forces to the liner 32 in each case by way of an annular shoulder 38 and 40, respectively. The distance between the liner 32 and the bottom 30 may be bridged by an annular spacer 42.

In the rest position shown in FIG. 1, the handle 14, in the direction of vibration of the tool or in the direction in which the guide rods 20 and 22 are guided, is at a distance from that end of the casing 12 which faces it. An approximately equally large distance is formed between that end of each guide rod 20 and 22 which engages in the handle 14 and the bottom 30 of the bushing 28. As a result of this relationship a vibratory movement of the handle 14 relative to the casing 12 in both guide directions from this rest position, that is to say forward and back, is possible. At the same time, the liner 32 permits a tilting movement of the guide rods 20 and 22 with respect to the axis of the bushings 28, the extent of the tilting movement depending on the elasticity of the liner 32 and the radial extent of the latter.

Figure 2:
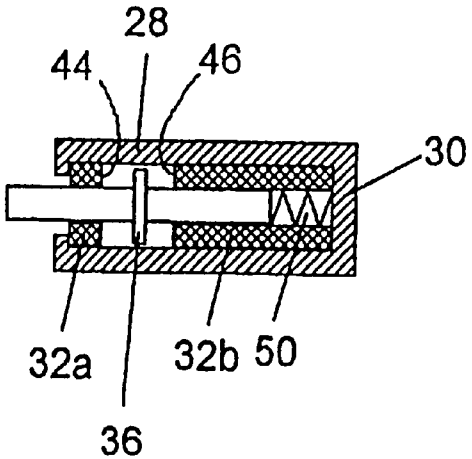
FIG. 2 shows a schematic detail section through a variant of the biasing system.

In the embodiment according to FIG. 2, on either side of the cross-sectional widening 36, a space is left free between the annular shoulders of the collar 36 and the end faces 44 and 46 of two liner parts 32*a* and 32*b* which are located opposite the annular shoulders. The guide rods 20 and 22 extend into bores in the two liner parts 32*a* and 32*b*. A compression spring 50 is inserted into the bore 34 of the liner part 32*b* between the free end of the guide rods and the bottom 30 of the bushing 28 as an axially acting spring element.

What is claimed is:

1. A breaking and drilling hammer, having a handle which is resiliently biased on all sides with respect to a hammer casing in a manner which permits limited movement of the handle with respect to the hammer casing;

at least one rectilinear guide which connects the handle to the hammer casing and which extends parallel to a longitudinal axis of the hammer and along which the handle can be displaced to a limited extent with respect to the hammer casing both in a direction of the longitudinal axis of the hammer and in a direction transverse to the longitudinal axis;

the rectilinear guide having an inner guide element and an outer guide element which surrounds the inner guide element at a distance;

at least one elastic element being inserted between an outer circumference of the inner guide element and an inner circumference of the outer guide element, the elastic element contacting and resiliently biasing the inner and outer guide elements away from one another both in the direction of the longitudinal axis of the hammer and in a direction transverse to the longitudinal axis; wherein at least one stop plane, which is perpendicular to a longitudinal axis of the hammer, is formed on the inner guide element;

the elastic element extends longitudinally between the stop plane and an end face of the outer guide element; and wherein the elastic element extends longitudinally from the stop plane to the end face a greater distance than the elastic element extends between the inner guide element and the outer guide element, whereby the elastic element has a greater elasticity in the direction of the longitudinal axis of the hammer than in a direction transverse to the longitudinal axis; and wherein a second elastic element extends between a second stop plane, provided on the rear of the stop plane, and a second end face of the outer guide element, the end face being opposite the end face of the outer guide element.

2. The hammer as claimed in claim 1, wherein the inner guide element is a guide rod and the outer guide element is a guide sleeve.

3. The hammer as claimed in claim 2, wherein the hammer includes two rectilinear guides, and wherein the handle has a U shape with essentially mutually parallel legs turned toward the hammer casing, and wherein one of the rectilinear guides is enclosed by each leg.

4. The hammer as claimed in claim 2, wherein each guide rod extends, parallel to the longitudinal axis of the hammer, from the hammer casing toward the handle, and wherein each guide sleeve is formed in the handle.

5. The hammer as claimed in claim 4, wherein each guide sleeve comprises a fixed bushing in the handle, and wherein the elastic element is a liner which 1) is inserted into the bushing, 2) is retained axially therein, 3) is formed from resilient material, and 4) is provided with a bore that extends at least over an entire length of the guide rod and has a cross section matching a cross section of the guide rod.

6. The hammer as claimed in claim 5, wherein the liner is also retained in an axial direction thereof on the guide rod.

7. The hammer as claimed in claim 5, wherein the guide rod is axially biased in the bore.

8. The hammer as claimed in claim 7, wherein a compression spring is supported on a free end of the guide rod and on a bottom of the bushing.

9. The hammer as claimed in claim 5, wherein the liner comprises a plurality of elastic liner parts that are inserted into the bushing in a manner allowing them to be replaced, and wherein the liner parts each have a different compressibility.

10. The hammer as claimed in claim 9, wherein at least one of the compressible liner parts is supported on a free end of the guide rod and on a bottom of the bushing.

11. The hammer as claimed in claim 5, wherein a radial projection on the guide element 1) forms the stop plane, 2) extends into a radial recess in the liner, and 3) has an axial length that corresponds to the maximum permissible displacement travel between the hammer casing and the handle.

12. The hammer as claimed in claim 11, wherein the radial projection is formed as an annular shoulder.

13. A breaking and drilling hammer, comprising:

a hammer casing;

a handle mounted on the hammer casing and movable to a limited extent both parallel to a longitudinal axis of the hammer and transverse to the longitudinal axis of the hammer;

at least one rectilinear guide which extends parallel to the longitudinal axis of the hammer, the rectilinear guide including an inner guide element and an outer guide element which surrounds the inner guide element in a spaced-apart relationship with respect thereto, one of the inner and outer guide elements being affixed to the hammer casing and the other of the inner and outer guide elements being affixed to the handle;

at least one elastic element which is located between an outer circumference of the inner guide element and an inner circumference of the outer guide element and which contacts the inner and outer guide elements so as to bias the rectilinear guide both longitudinally of the hammer and laterally of the hammer to a neutral position thereof; wherein at least one stop plane is formed on the inner guide element, the stop plane being perpendicular to the longitudinal axis of the hammer;

the elastic element extends longitudinally of the hammer between the stop plane and a transverse end face of the outer guide element; and wherein the elastic element extends longitudinally from the stop plane to the end face a greater distance than the elastic element extends between the inner guide element and the outer guide element, whereby the elastic element has a greater elasticity in the direction of the longitudinal axis; and wherein a second elastic element extends between a second stop plane, provided on the rear of the stop plane, and a second end face of the outer guide element, the end face being opposite the end face of the outer guide element of the hammer than in the direction transverse to the longitudinal axis.

14. The hammer as claimed in claim 13, wherein the inner guide element comprises a guide rod and the outer guide element comprises a guide sleeve.

15. The hammer as claimed in claim 14, wherein the guide sleeve comprises a fixed bushing in the handle, and wherein the elastic element comprises a liner which 1) is inserted into the bushing, 2) is retained axially in the bushing, 3) is formed from a resilient material, and 4) has a bore formed therein which receives the guide rod, which extends at least over an entire length of the guide rod, and which has a cross section matching a cross section of the guide rod.

16. The hammer as claimed in claim 15, wherein a compression spring has a first end supported on a free end of the guide rod and a second end supported on a bottom of the bushing.

17. The hammer as claimed in claim 15, wherein the liner is formed from a plurality of elastic liner parts which are inserted into the bushing in a manner allowing them to be replaced, and which have different compressibilities.

18. The hammer as claimed in claim 15, wherein the liner includes at least one compressible liner part which has a first end supported on a free end of the guide rod and a second end supported on a bottom of the bushing.

19. The hammer as claimed in claim 15, wherein a radial projection on the guide rod forms the stop plane, extends into a radial recess in the liner, and has an axial length that corresponds to a maximum permissible displacement travel between the hammer casing and the handle.

* * * * *